US005186881A

United States Patent [19]

Beaman

[11] Patent Number: 5,186,881

[45] Date of Patent: Feb. 16, 1993

[54] METHOD FOR MANUFACTURING HOLLOW CONCRETE STRUCTURES

[76] Inventor: Samuel W. Beaman, 5233 Petty St., Houston, Tex. 77007

[21] Appl. No.: 788,209

[22] Filed: Nov. 5, 1991

Related U.S. Application Data

[62] Division of Ser. No. 502,770, Apr. 2, 1990, Pat. No. 5,090,884.

[51] Int. Cl.[5] ..... B28B 1/02; B28B 1/16; B28B 7/10; B28B 13/06

[52] U.S. Cl. ..... 264/256; 264/263; 264/273; 264/275; 264/279.1; 264/310; 264/333; 264/334

[58] Field of Search ..... 264/256, 279.1, 310, 264/333, 263, 273, 275, 279, 308, 334, 336

[56] References Cited

U.S. PATENT DOCUMENTS

| | | | |
|---|---|---|---|
| 860,184 | 7/1907 | Beckwith | 264/256 |
| 1,156,077 | 10/1915 | Higgins | 264/256 X |
| 1,452,665 | 4/1923 | Tindall . | |
| 2,834,088 | 5/1958 | Miller . | |
| 3,003,188 | 10/1961 | Weiss . | |
| 3,723,044 | 3/1973 | Motheral . | |
| 3,875,275 | 4/1975 | Lemelson | 264/310 X |
| 4,022,859 | 5/1977 | Fioretto | 264/71 X |
| 4,042,659 | 8/1977 | Botting et al. . | |
| 4,080,129 | 3/1978 | Little . | |
| 4,149,697 | 4/1979 | Linetsky . | |
| 4,178,338 | 12/1979 | Bondpers et al. | 264/336 X |
| 4,606,878 | 8/1986 | Day et al. | 264/333 X |
| 4,869,620 | 9/1989 | Dow . | |
| 5,039,297 | 8/1991 | Masters | 264/71 X |

FOREIGN PATENT DOCUMENTS

| | | | |
|---|---|---|---|
| 2122874 | 3/1972 | Fed. Rep. of Germany | 249/27 |
| 174408 | 7/1989 | Japan . | |
| 305062 | 7/1971 | U.S.S.R. | 249/27 |

*Primary Examiner*—Karen Aftergut
*Attorney, Agent, or Firm*—Pravel, Gambrell, Hewitt, Kimball & Krieger

[57] ABSTRACT

A method for forming hollow concrete structures or shells in which the top, bottom and sides are formed into an integral unitary structure by rotating an assembly of reinforcing members to enable the concrete forming the top, bottom and side to each be finished in a substantially horizontal position with a minimum of forms. Openings for doors and windows may be formed by using suitable blanks that are prepositioned prior to pouring the concrete. Also, suitable end closure members can also be formed in a flat or horizontal position inside the unitary structure for subsequent erection in a vertical position.

2 Claims, 4 Drawing Sheets

METHOD FOR MANUFACTURING HOLLOW CONCRETE STRUCTURES

This is a division of application Ser. No. 07/502,770 filed Apr. 2, 1990, U.S. Pat. No. 5,090,884.

BACKGROUND OF THE INVENTION

1. FIELD OF THE INVENTION

The invention relates to the art of forming unitary concrete shell structures suitable for use in housing and the like. Particularly, the invention relates to an apparatus and method of forming an integral concrete shell in a rotatable form in which each of the structural portions of the shell such as sides, top and bottom is formed progressively by pouring and finishing the concrete for each portion when it is positioned in a substantially horizontal position.

2. DESCRIPTION OF THE PRIOR ART

The prior art is replete with examples of various efforts to mass produce housing units of concrete such as is represented by U.S. Pat. Nos. 3,558,095; 3,853,452; 3,993,720; 4,426,060; and 4,828,217 as well as prior art patent 3,932,082 issued to the present inventor. Among this prior art the inventor's patent, U.S. Pat. No. 3,932,082, provides a means for making a reinforced concrete module suitable for use as a housing structure in which the walls, as well as the top and bottom are formed in a substantially horizontal position. The other references employ typically moveable forms for forming the walls between inner and outer vertical forms which are cumbersome and require substantial additional structure and labor for positioning the forms relative to each other preparatory to receiving the concrete and for subsequently removing the forms after the concrete has set up or, the prior art requires that a series of flat slabs be secured together to form a box-like structure. The prior art patent of the inventor discloses an apparatus for rotating a cage-like structure of reinforcement material, but even it suffers from the disadvantage of having to pick up the entire assembly in order to rotate it so as to position the various sides in a horizontal position for receiving the concrete.

SUMMARY OF THE INVENTION

The present invention provides a structure and method for rotating a cage-like assembly of concrete reinforcing material to enable the top, bottom, sides and ends of a housing unit to each be formed in substantially a horizontal position without having to lift the cage structure to rotate it about its axis.

It is an object of the present invention to provide a preformed concrete structure having a plurality of tubular conduit ways to enable the individual units to be stacked together and/or side by side to provide a multistory structure with integral passageways for routing wiring through the various units and also to provide a series of passages for receiving post-tensioning cables rove through the passages to secure the multi-unit structure together.

It is also an object of this invention to provide a forming structure wherein a longitudinally extending square, rectangular or other polygonal form is encircled by an outer cylinder which is rotatably mounted for rotating the longitudinally extending square, rectangular or other form so as to position its top, bottom and each of the sides of the multi-sided form in a horizontal position suitable for receiving and finishing each side of the multi-sided structure sequentially without having to wait for each side to cure before rotating the next adjacent side into horizontal position for receiving cement while also allowing the surface of the concrete on each side to be finished in a substantially horizontal position. The longitudinally extending form, as well as the surrounding cylinder, are split into two mating halves that are adapted to be separated by pivoting one-half with respect to the other to facilitate both the insertion of a substantially rigid box-like cage structure of concrete reinforcing material and also for removing the finished unitary structure once the concrete has set up sufficiently to enable it to be moved as an integral unit.

DETAILED DESCRIPTION OF THE DRAWINGS

DETAILED DESCRIPTION OF THE INVENTION

Figure 1:
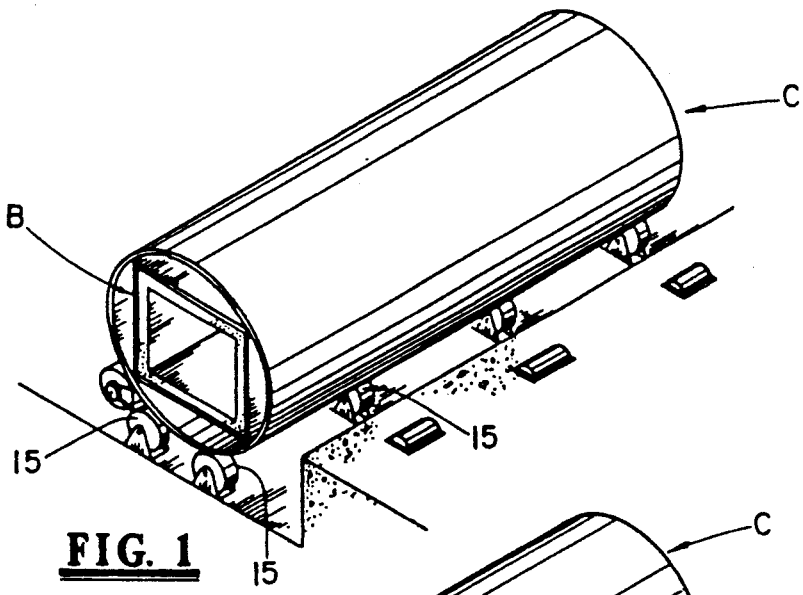
FIG. 1 is an isometric perspective of the forming machine containing a building structure formed in place therein.
Figure 1A:
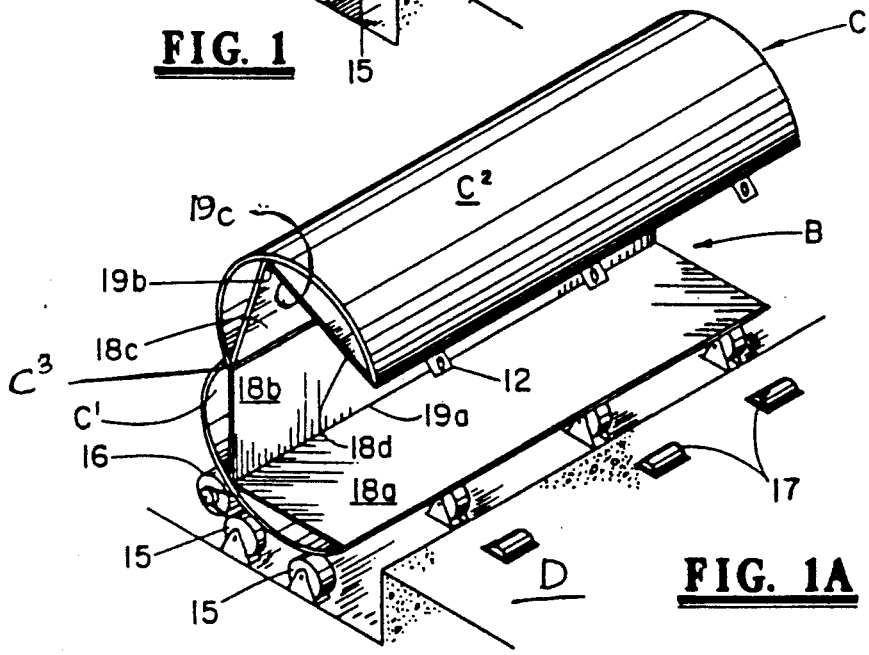
FIG. 1A is also an isometric perspective of the forming machine empty and open with the unitary structure removed therefrom.
Figure 5:
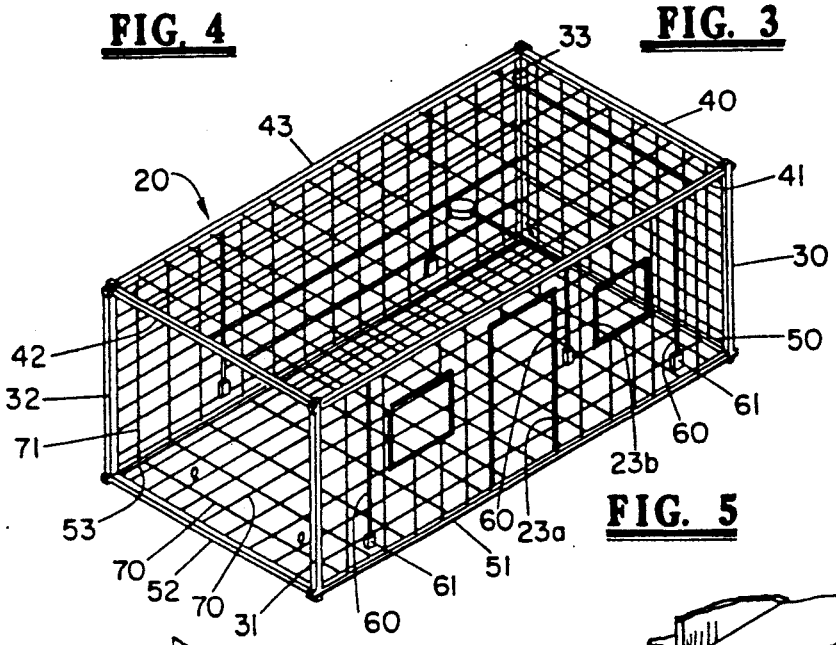
FIG. 5 is a isometric view showing the concrete reinforcing assembly prior to being covered with concrete.

Referring now to FIG. 1 of the drawings, the present invention as shown in isometric perspective includes a rotatable cylinder indicated generally C having a longitudinally extending rectangular or square shaped box form B positioned in the cylinder for receiving a reinforcing wire or rod cage (FIG. 5). As shown in FIG. 1A, the cylinder C is split into two halves longitudinally as is the internal box form B with the two halves $C^1$, and $C^2$ hinged along one cut line $C^3$ to enable the cylinder half $C^1$, and the box portion B, to be moved apart and together with respect to the other half $C^2$ to enable the forming machine to be opened and closed. Latch means 12 are provided for securing the two halves in the closed position.

Also, as shown in the drawing, the cylinder C is mounted on a set of spaced pairs of rollers 15 to facilitate turning the cylinder and its contents through a complete revolution of 360 degrees or more or less, as desired without lifting the forming apparatus or the structure contained therein. A drive motor 16 is shown for rotating the cylinder C, or holding it against rotation, as the case may be. Also in the preferred embodiment, a loading dock D is positioned adjacent to the cylinder C to facilitate transferring the completed structure or the reinforcing cage assembly 20 illustrated in FIG. 5 from a flat bed truck, low boy or other transportation device into the open box in the cylinder C and also to facilitate removal of the building structure S from the forming box B after it has been completed and transferring it to a trailer or other equipment for movement to a building site. A plurality of rollers 17 is fitted into the loading dock to facilitate handling the reinforced wire cage and also the completed structure in loading and unloading operations.

The inner box B comprises two pairs of perpendicular plates 18*a* and 18*b*, and 18*c* and 18*d* which are preferably steel or other metal plates welded or secured together at their adjacent edges such as 19*a* and 19*b*, respectively. The pairs of joined plates are secured to their adjacent half cylinders $C^1$ and $C^2$ and may include intermediate bracing such as indicated at 19*c*.

Figure 2:
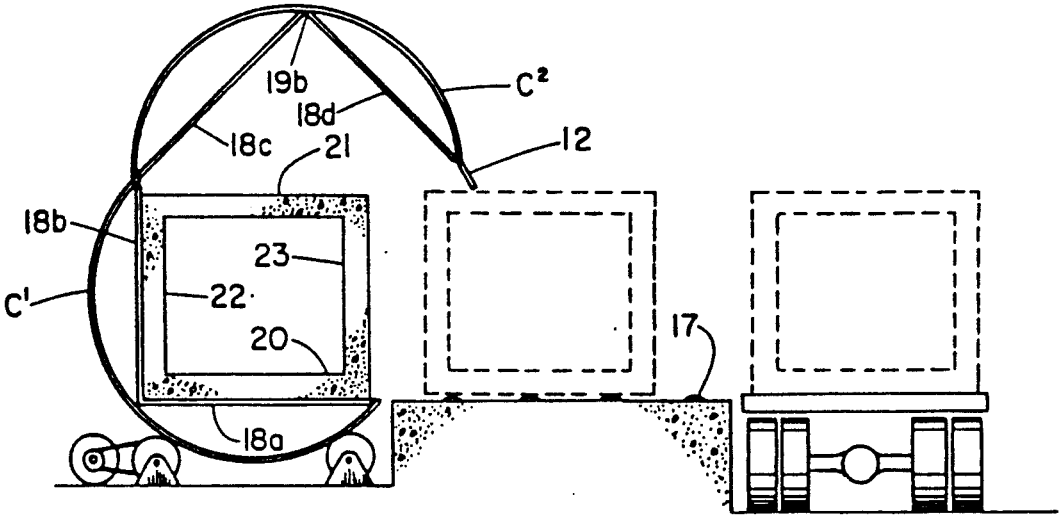
FIG. 2 is an end view showing a unitary building structure in place in the opened forming machine with the unitary structure shown in phantom first on a loading dock and also loaded on a trailer.
Figure 3:
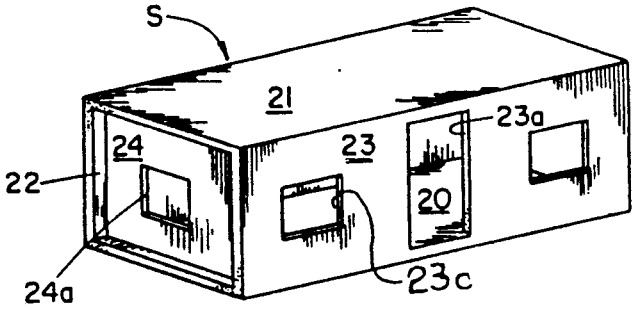
FIG. 3 is an isometric view of the finished building structure.

In FIGS. 2 and 3, there is shown a structure which includes a floor 20, a roof 21 and two walls 22 and 23. Also an end 24 is shown in the building structure and a similar end (not shown) may be included in the opposite end of the structure or, if desired, a second structure similar to the first may be attached. A single window 24*a* is placed in the end 24 but it will be appreciated that a door, either hinged or sliding may be included in the end closure as desired. Also, shown in side 23 is a door opening 23*a* with window openings 23*b* and 23*c*. It will be appreciated that the structure S of the present invention lends itself to any number of configurations in that it can be constructed with no door or window openings at all and thus be suitable for use as a water storage tank or cistern, or, it may have such door(s) and window(s) positioned in virtually any position desired so long as structural integrity is maintained. It may, for example, also include openings in the roof for skylights or a suitable opening in the floor to receive a stairway should it be desired to elevate the structure in either a freestanding or multi-storied configuration.

Figure 4:
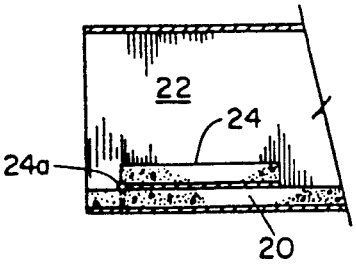
FIG. 4 is a partial cutaway view showing an end member in the substantially horizontal position in which it is formed with hinge means for pivoting it into a position.

As shown in FIG. 4, end closure member 24 may also be formed in a horizontal position after the floor 20 has been formed and preferably after the sidewalls and roof have also been formed so that further rotation of the structure is not required. The end member 24 can be formed in place on the floor 20 or on one side or the roof by using a suitable parting compound or other separable member to prevent adhesion of the end 24 with the floor 20, roof 21 or side wall. If desired, the reinforcing members may include a pivotable rod or hinge 24*a* for pivotally mounting the end member 24 in the structure S. The end member 24 can be placed flush at the ends of the walls 22 and 23 or it may be recessed away from the ends to provide a space for an outdoor porch, or, if desired, by recessing end member in the structure, space may be provided for positioning hinged end closure members which may also be made of concrete and which may be closed to provide protection against hurricanes, tornadoes, or other high winds. Also, it should be understood that the structure S may be transported with the end member in its reclined position as shown in FIG. 4 and later to be pivoted and secured in place after the structure has been permanently placed in position. Internal walls (not shown) may also be formed this way.

To meet load size requirements, it may be desirable to transport the structure S on its side. In that case, it may be preferred to rotate the unitary structure an additional 90° past the complete revolution of 360° after the two sides, floor and roof have been completed so as to be able to form the end members on the then upturned inner surface of one of the walls 22 or 23. With suitable internal bracing, the end member 24 can be held in position adjacent the wall on which it was formed while unitary structure S is being turned back into an upright position at the building site or elsewhere. Thereafter, with the end member hinges or pivot means disposed in a vertical position, it will be relatively simple for a workman to swing the end member around into a position to close the end of the structure S. Suitable sealing or caulking means may then be applied to seal the spaces around the perimeter of the end member between its edges and the surrounding walls, roof and floor.

Figure 6:
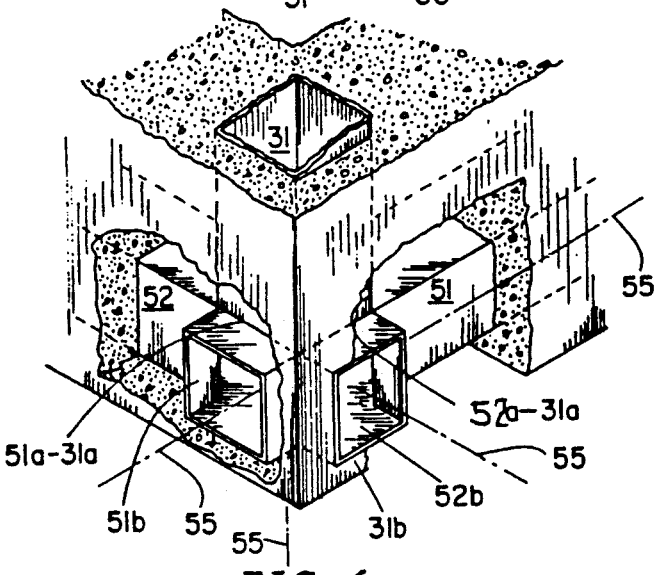
FIG. 6 is a partial broken away view showing details of the tubular reinforcing framework.

As illustrated in FIG. 5, the reinforcement assembly includes vertical tubular members 30, 31, 32 and 33 positioned at or near the four corners of the structure S as well as upper perimeter members 40 41, 42 and 43 and lower perimeter members 50, 51, 52 and 53. FIG. 6 illustrates one arrangement for connecting three intersecting tubular members 31, 51, and 52 together to form a corner of the structure S. With this arrangement, the tubular members are welded together at their respective lines of intersection such as at line 51*a*–31*a* which provides short stub ends such as 51*b* and 52*b* and 31*b* which extend beyond the intersection of the tubes 51, 52 and 31, respectively. The stub end portions 51*b* and 52*b* and 31*b* are preferably of such a length to match the thickness of the concrete overlaying the reinforcing cage so as to provide a smooth surface with the stub ends abutting that surface. Further it will be appreciated that the tubes may, if desired, receive post-tensioning cables 55 to tie adjacent structures together either side-by-side or stacked one above another and such tubes may also provide passageways for receiving electrical conduit as well as telephone and/or television cables or conduits led to the various structures. It will also be appreciated that intermediate tubular members, either transversely or longitudinally, may be positioned so as to extend all or part of the way along or across the walls, floor or ceiling to accommodate electrical conduits and the like.

FIG. 5 also illustrates electrical conduits 60 and electrical outlet box 61 which may be connected independently or integrally with the tubes as desired. The horizontal and vertical reinforcing rods or members 70 and 71 will be of such a size as good engineering dictates for the strength required for a particular structure and, if required, may also be in the form of either expanded metal or a wire mesh to provide suitable concrete reinforcing for the particular structure. The rods may be tied or welded together and also welded or otherwise secured to the tubular frame. In any event, in the preferred form of this invention the box-like cage structure of reinforcing bars and/or tubes is assembled prior to being placed in the box form B for receiving concrete on each of the sides of the structural member. Openings for receiving the door and windows 23*a*, 23*b* and 23*c* may be provided by placing removable inserts or plugs in position during the forming of the concrete or, a door frame and window frames may be included in the reinforcing assembly, if desired. For example, these could be formed of steel and provide a suitable frame for receiving either a door or window as the case may be and such steel frames may be welded to the adjacent reinforcing bars or rods if desired. Also, it will be appreciated that suitable concrete chairs (not shown) may be used to support the reinforcing bars 70 and 71 intermediate their ends to prevent sagging of the reinforcing rods adjacent the box form to thereby position the reinforcing members at some desired space internally of the concrete wall.

With the reinforcing cage structure positioned in the box form B, concrete is first applied to the lower reinforcing members and the top surface of that side finished smooth. This first side is allowed to set-up sufficiently so as not to sag away from the adjacent portion of the box form underlying the concrete when the cylinder and box form are rotated 90 degrees to position the next adjacent panel or wall in a substantially horizontal position for receiving concrete. Thus, by applying concrete to each of the various sides of the square or rectangular longitudinally extending structure shown in FIG. 3 sequentially and finishing each side in a substantially horizontal position an integral concrete hollow tubular building structure may be made without the necessity of having complicated forms for forming both sides of the floor, ceiling or side or end walls.

Figure 7:
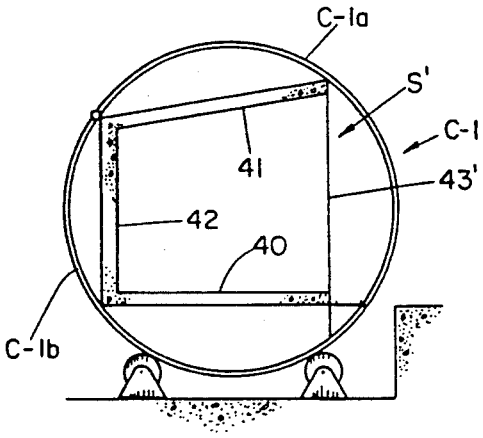
FIG. 7 is a transverse sectional view of the forming machine of the present invention with a tilted roof structure therein.
Figure 7A:
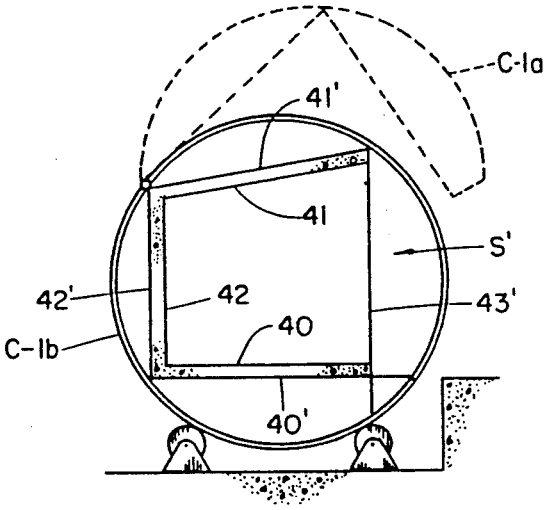
FIG. 7A is a transverse view the same as FIG. 7 but with the forming machine open.
Figure 8A:
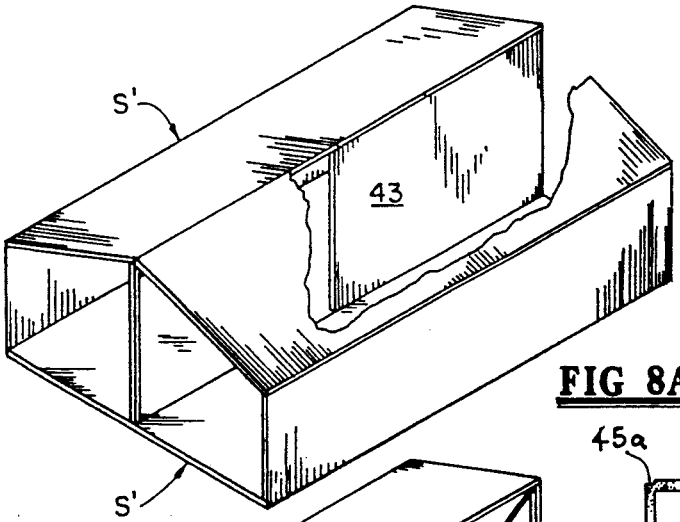
FIG. 8A is an isometric view with a portion broken away showing a tilted roof structure.

With respect to the embodiment of FIGS. 7 and 7A, it will be appreciated that the various surfaces for receiving concrete to complete the various sides and the top or bottom or one side and a partial top and partial bottom of a building structure may be accomplished using the present-invention. This is true whether the structure has four surfaces such as a top, bottom and two sides, which are formed serially or, in the event it is desired, to produce a structure as illustrated in FIGS. 7 and 7A which include the possibility of only a three-sided structure S'. For example, a structure as shown in FIGS. 7 and 7A having a partial bottom 40, a partial roof 41, and one side wall 42 can be produced with the forming apparatus shown in FIGS. 7 and 7A. The forming member or panel 43' is provided with the forming panels $\mathbf{40}^1$, $\mathbf{41}^1$, and $\mathbf{42}^1$ to close the perimeter of the forming structure and, if it is desired to have a fourth wall or a partial fourth wall 43, to provide a forming means for such wall. In FIG. 8A is shown a partial wall extending longitudinally only part of the distance along that side of the structure S'. Such partial wall 43 may have a door or opening (not shown) that can be provided therein by using a blank or a plug to make such an opening at the time the concrete is poured.

When completed, this half structure S' may be removed from the open box form (FIG. 7A) and be subsequently joined together in the field or at the building site with a mating part as shown in FIG. 8A. Of course, the two mating structures S' may be joined together by the use of post-tension cables rove through the perimeter tubular members such as 51 and 52 shown in FIG. 6 of the drawings or by welding imbedded metal plates formed in adjoining portions of the structure.

Figure 8B:
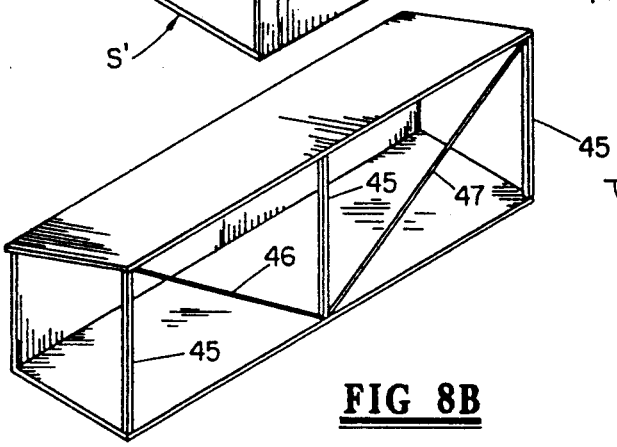
FIG. 8B is an isometric view of a portion of a tilted roof structure according to the present invention.

As shown in FIG. 8B, suitable removable reinforcing members, such as braces 45, 46 and 47, are used to support the roof along the open side of the partial structure until the two halves S' have been permanently joined together as shown in FIG. 8A. With the apparatus of FIGS. 7 and 7A, the wall 42, floor 40 and roof member 41 are formed substantially the same way with respect to the embodiment shown in FIGS. 1, 2 and 3, i.e., a cage of reinforcing material is positioned in the forming machine and each surface to be formed is sequentially positioned horizontally by turning the cylinder C for receiving the concrete in a liquid form on a horizontally positioned forming member so that the upper surface of the concrete can also be finished horizontally.

Once the concrete that has been applied to the reinforcing cage has been allowed to cure to the point that it may be moved, the latches means 12 is released and the upper portion C-1*a* of the split cylinder C-1 is pivoted and raised into the position shown in FIG. 7A so that the structure S' may be removed from the cylinder in the manner illustrated in FIG. 2.

It will be appreciated that suitable parting compound will be used on the surfaces of the box form B to enable the completed structure to be broken away from the box form by parting the cement from the form without damaging the surface of the finished cement.

After removal, the structure S may be transported to a selected site and there placed in a level position. The final finishing, such as painting and the installation of plumbing and electrical fixtures may also be accomplished away from the forming machine so as not to interfere with rapid production of additional unitary structures.

Figure 6A:
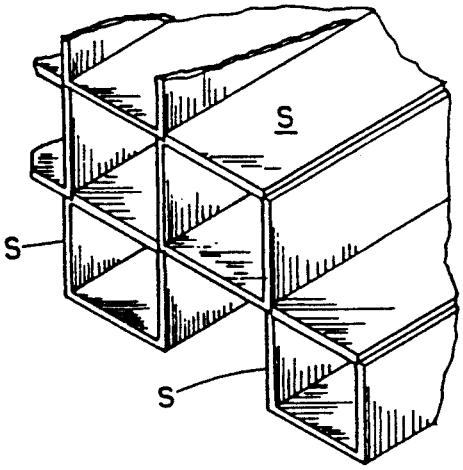
FIG. 6A shows a plurality of structural units stacked together to form a multistory structure.
Figure 6B:
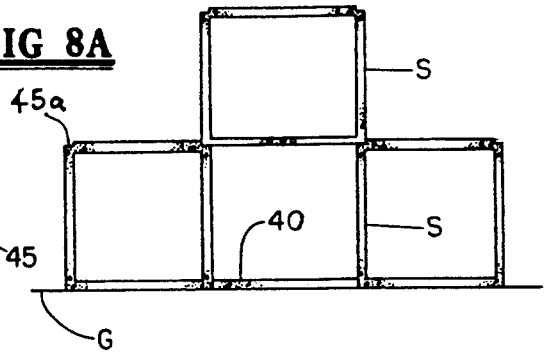
FIG. 6B is a schematic view similar to FIG. 6A showing a plurality of unitary building structures stacked together.

In the embodiment shown in FIGS. 6A and 6B, a longitudinally extending notch or recess 48 is provided at the opposite edges of the roof 21 for receiving other units S stacked thereon. The recess 48 may include an angle member 45*a* of steel as other material which may be welded to the reinforcing members of the tubes such as 51. Also, a mating angle member may be provided on the opposite lower edges of the units S. Also, it will be appreciated that suitable openings (not shown) will be made through the angle members 45*a* corresponding to openings in the tubes 51 and 52 for allowing post-tensioning cables 55 or electrical or other cables to be passed through such angle members 45*a*. The structures may of course be stacked one upon another as shown in FIG. 6A or in various arrangements to provide a variety of architectural designs for multi-story buildings. Also the structures may be positioned at grade G in spaced apart relationship as shown in FIG. 6B with another structural member positioned on top of the two spaced units at grade level, so as to span the space between such grade level units and a suitable floor 46 may be provided in such space. Thus, one advantage of the present invention is that prefabricated, and indeed, prefinished units may be quickly and inexpensively produced, which units are of such a structural integrity that they may be stacked on top of each other to create a structurally sound building. Of course, in order to achieve the desired weight bearing characteristics, it may be necessary that lower units be constructed with greater load carrying capacity than upper units, but this can be readily accomplished by increasing the size/-number of reinforcing rods and, if need be, making the walls, or other structural portions, somewhat thicker or heavier in the lower units than in the higher positioned units.

Figure 9:
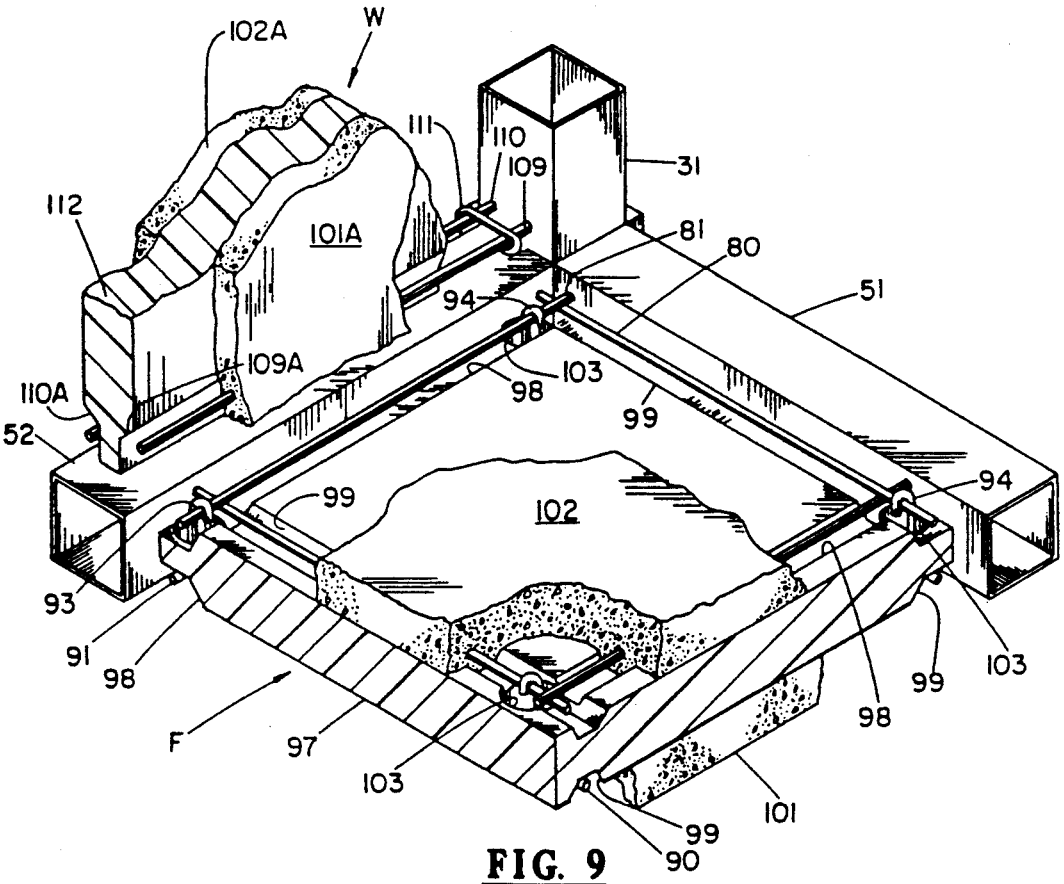
FIG. 9 is an isometric view, partially cut away to show details of construction of a wall and/or floor panel having insulation material cast into the concrete.

Another alternate embodiment of the apparatus of the present invention is shown in FIG. 9 of the drawings, wherein a floor section F and a wall section W are shown. However, it will be appreciated that the insulated structure illustrated here may also be applied to the other vertical wall as well as the roof of the structural unit so as to provide insulation material in each of the external surfaces, or, if desired, such insulating material may be provided in any one or more of the various external wall, roof or floor sections. Also, of course, this type of structure may be employed in the end closure members 24 as well.

Considering the details of the structure shown in FIG. 9, the perimeter tubular framework consists of tubular members 51 and 52, as well as a vertical tubular member 31 corresponding to those shown in FIG. 6 of the drawings. In the broken-away views of the floor F and the wall W, there are shown the various reinforcing rods, such as 80 and 81, which form an upper grid and 90 and 91 which form a lower grid. Clamping members 93 and 94 are shown which connect the upper and lower grids together. Disposed between such upper and lower grids is a sheet of plastic foam or other suitable insulating material 97 which is formed with suitable recesses such as 98 and 99, which are provided for receiving the concrete which normally surrounds the reinforcing rods 80 and 81. There are similar recesses 98 and 99 on the opposite side of the plastic foam or other insulating material sheet which provides space for receiving concrete that surrounds the rods 90 and 91.

Thus, it will be appreciated that with respect to the floor section F, the floor is a composite which includes a lower layer of concrete 101 and an upper layer of concrete 102 which are positioned on opposite sides of the plastic insulation member 97, with longitudinally and transversely extending channels or recesses, 98 and 99 as well as transverse openings 103 surrounding the clip members 93 and 94. This structure provides not only means for communication to allow the liquid concrete to pass beneath the insulating insert 97, but also, when finished, provides a series of transverse structural links connecting the beams formed along channels 98 and 99 on opposite sides of the styrofoam 97.

Similarly, with respect to the wall portion W, it will be seen that an inner and outer grid of reinforcing bars, such as 109 and 110, connected together by tie wires or clips 111, are also spaced apart with suitable insulating material such as sheets of foam 112 positioned between the rods 109 and 110. Similar to the foam block 97 in the floor F, the foam 112 is provided with longitudinally extending grooves or recesses 109A and 110A for receiving concrete surrounding the rods or bars 109 and 110 so as to form longitudinally extending structural members. Also, with respect to the wall section W, it too is provided with transverse openings such as 103 (not shown) which surround the tie wires 111 so as to enable the concrete to extend transversely from one side to the other of the wall and thereby provide a plurality of spaced structural members running transversely with respect to the longitudinal rods 109 and 110. As shown in the drawing, the concrete, such as 101A and 102A, is applied ultimately so as to be positioned on each side of the foam 112 to thereby provide a structurally sound and yet insulated wall, floor or roof section as desired.

Figure 10:
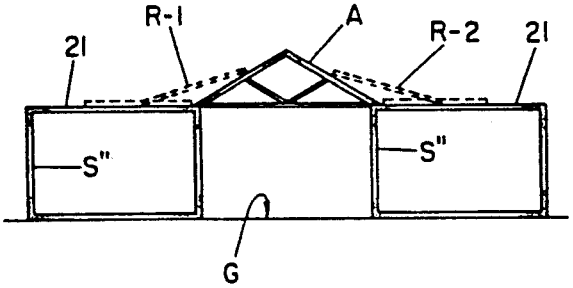
FIG. 10 is an end view showing spaced structural units with roof sections in phantom being moved into position.
Figure 11:
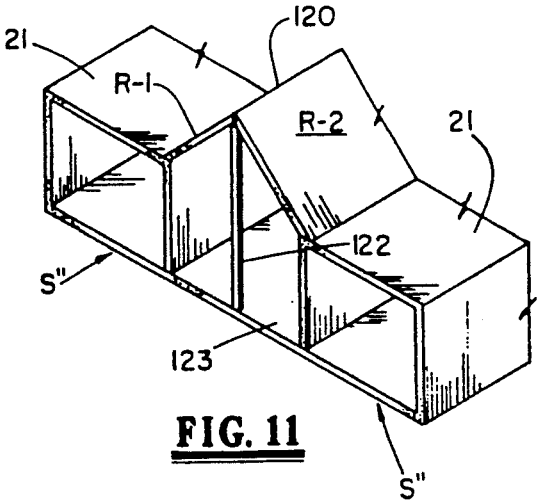
FIG. 11 is a partial isometric view of a building similar to that shown in FIG. 10 with the roof in final position.

Another alternative embodiment of the present invention is shown in FIGS. 10 and 11 wherein a pair of laterally spaced structures S″ are positioned; preferably on grade G for receiving roof sections R1 and R2 which are positioned in inclined position so as to span the area between the two adjacent building structures S″. As shown in FIG. 10, the roof structure R1 and R2 are moved from a horizontal position on the roof 21 of each structure S″ into an inclined position spanning the space between the structures. As illustrated in phantom in the drawing, the roof sections R1 and R2 are each moved from a horizontal position to the inclined position as shown. An A-frame member is positioned between the houses and provides a guide and support for moving the roof sections R1 and R2 from horizontal to inclined position. It would be appreciated that the structure is presented in an end view in FIG. 10 and that a plurality of A-frames are spaced longitudinally with respect to the structures S″ so as to provide a plurality of A-frame supports for guiding and supporting the roof sections R1 and R2 while they are being moved into the position shown in FIG. 11. Once the roof sections are erected in this position, their abutting edges 120 may be secured together such as by welding or other suitable means.

It would thus be appreciated that roof sections are formed after the structures S″ have been removed from the cylinder C and are formed in place on the horizontal roof section 21 with a suitable parting compound deposited on top of the roof 21 prior to forming the concrete roof panel sections R1 and R2. Also at the time of forming the roof sections, a steel connecting plate 120 can be formed integrally with the reinforcing wire or rods which are used for reinforcing the roof section. These wires or rods are not shown in detail, but it would be appreciated that a suitable set of reinforcing wires or rods will be included in the roof sections R1 and R2.

Further, any suitable means, either a crane or a come-along or other type device may be used for pulling the roof sections R1 and R2 up the inclined A-frame support system from horizontal to inclined position after the structures S″ have been positioned on the desired building site. Also, it will be appreciated that once the roof sections R1 and R2 have been poured and cured sufficiently for being moved, that the structures S″ may then be transported to the building site with the roof sections R1 and R2 lying horizontally on the roofs 21, and of course they will be secured sufficiently to be transported from the building assembly area to the building site. Also, it will be appreciated that, if desired, the roof sections R1 and R2 may actually be formed and poured in place in situ on the structures S″ and then after suitable curing erected in the inclined position shown in FIG. 11. Also, as shown in FIG. 11, one or more vertical support members such as 122 may be provided for supporting the joined upper edges of the roof sections R1 and R2, and, also as shown, is a floor 123 which has been provided in the space between the adjacent structures S″. Also, in the preferred embodiment of FIG. 11, the lower edges of the roof sections R1 and R2 are also provided with a steel plate or other means for attaching them to the adjacent edges of the structures S″.

It would be appreciated that with the method and apparatus of the present invention, unitary concrete building structures may be produced which have the options of various sizes and shapes, both in a single unit mode, as well as in multiple units which, if desired, may be stacked and tied together with suitable post tensioning cables so as to provide an integral structure. Further, the walls, ceilings and/or floors may also be provided with insulation so as to provide a structure that not only is structurally sound, but also has the added advantages of being insulated.

The foregoing disclosure and description of the invention are illustrative and explanatory thereof, and various changes in the size, shape and materials, as well as the illustrated construction, may be made without departing from the spirit of the invention.

I claim:

1. A method of forming a unitary concrete modular building structure comprising the steps of:

(a) forming a multi-sided assembly of concrete reinforcing material shaped to substantially a size and shape of a desired building structure;

(b) inserting said assembly of concrete reinforcing material into a rotatable form comprising a plurality of substantially flat surfaces each of which corresponds and is spaced uniformly from one side of said multi-sided assembly for receiving liquid cement to be a applied to said assembly;

(c) applying a desired amount of liquid cement to a side of said reinforcing assembly after positioning said side and its corresponding flat form surface in a substantially horizontal position, to cover an inner surface of said reinforcing assembly to a desired amount;

(d) finishing an upper surface of said liquid cement above said inner surface of said reinforcing assembly, while said reinforcing assembly is in said substantially horizontal position;

(e) rotating said form and said concrete reinforcing assembly sufficiently to position another side of said assembly and its corresponding substantially flat form surface in said substantially horizontal position;

(f) applying a desired amount of liquid cement to said another side of said relationship assembly when that side and its corresponding flat form surface is in said substantially horizontal position to cover an inner surface of said reinforcing assembly to a desired amount;

(g) finishing an upper surface of said liquid cement above said inner surface of said another side of said reinforcing assembly, while said reinforcing assembly is in said substantially horizontal position;

(h) further rotating said form and said concrete reinforcing assembly sequentially so as to position each further side of said reinforcing assembly in a substantially horizontal position for receiving and finishing of liquid cement until all sides of said multi-sided assembly are covered with a desired amount of said liquid cement to form said unitary concrete structure; and (i) removing said concrete structure from said form.

2. The method of claim 1 wherein said form comprises at least two sections having adjacent edges pivotally secured together with means for pivoting one section into closed or open relationship to the other section and wherein one section is pivoted to said open position and said completed concrete structure is removed from said form.

* * * * *